United States Patent [19]

Lawter et al.

[11] 4,422,782

[45] Dec. 27, 1983

[54] RECORD MEMBER FEED AND SUPPORT MECHANISM

[75] Inventors: Raymond L. Lawter, Zanesville; David C. Wills; Narinder Singh, both of Cambridge, all of Ohio

[73] Assignee: NCR Corporation, Dayton, Ohio

[21] Appl. No.: 392,449

[22] Filed: Jun. 28, 1982

[51] Int. Cl.[3] ..... B41J 11/20

[52] U.S. Cl. ..... 400/56; 400/636

[58] Field of Search ..... 400/656, 55, 56, 57, 400/58, 59, 60, 636, 27, 28, 41

[56] References Cited

U.S. PATENT DOCUMENTS

| | | | |
|---|---|---|---|
| 3,421,612 | 1/1969 | Pitt | 400/636 X |
| 3,837,461 | 9/1974 | Waibel | 400/56 |
| 4,227,819 | 10/1980 | Manriquez | 400/56 |

FOREIGN PATENT DOCUMENTS

| | | | |
|---|---|---|---|
| 1420301 | 1/1976 | United Kingdom | 400/56 |

OTHER PUBLICATIONS

IBM Technical Disclosure Bulletin, vol. 23, No. 9, Feb. 1981, p. 4252, "Self-Lifting Spring Platen and Forms-Feed Assembly", by Schall.

*Primary Examiner*—Edgar S. Burr
*Assistant Examiner*—Charles A. Pearson
*Attorney, Agent, or Firm*—J. T. Cavender; Wilbert Hawk, Jr.; Richard W. Lavin

[57] ABSTRACT

A feed mechanism for moving a record member into a printing position in which a single control solenoid is energized to enable a pair of drive rollers to move a multi-form record member from a holding position to a printing position. Operation of the solenoid further moves a platen member into engagement with the record member which is spring urged to enable the platen to apply a force on the record member. The force on the platen is selected to compensate for the thickness of the record member allowing a dot matrix printer to print satisfactorily on record members of varying thicknesses. The drive rollers are normally positioned to locate a record member in a validating printing position. Spring means are associated with the drive rollers to engage and hold the record member in a printing position during the operation of the solenoid.

10 Claims, 4 Drawing Figures

RECORD MEMBER FEED AND SUPPORT MECHANISM

BACKGROUND OF THE INVENTION

The present invention relates to printing mechanisms and more particularly to a feed and support mechanism associated with a printing mechanism for printing data on sales slips or other record members associated with a data terminal device.

As part of a sales operation, a sales slip or other type of record member or document is positioned in a printing station to allow a printing mechanism to print data relating to the purchase of a merchandise item. Besides the printing of data on the sales slip, the same data is printed on other record members such as a receipt member and a journal member during the sales operation.

As part of the printing operation, a paper feed mechanism will advance the record members to a printing position prior to the printing of each line of data. Printing mechanisms which have been utilized in modern data terminal devices have included the dot matrix printer which is normally mounted on a movable carriage for movement in a horizontal direction to print lines of data on the sales slip, receipt and journal record members positioned in a side-by-side arrangement adjacent the path of movement of the carriage. Pressure rollers are used to increment the record members to a printing position, together with stop members for aligning the record members in the printing position. Each of these printer control members is normally operated by a separate solenoid actuator which contributes a large cost factor to the cost of the data terminal device. When the thickness of the inserted document varies, complicated mechanisms have also been required for controlling the positioning of the printing platen to compensate for the thickness of the record member being printed and thus enable the printing mechanism to print satisfactorily on the document regardless of its thickness. These devices are usually controlled manually by the operator and must be preset for each particular printing operation.

It is therefore a principal object of this invention to provide a mechanism which automatically feeds a sales document or other type of record member to a predetermined printing position prior to a printing operation while controlling the position of the printing platen in accordance with the thickness of the document being printed. It is a further object of this invention to provide such a mechanism which is simple in construction and therefore low in cost.

SUMMARY OF THE INVENTION

These and other objects of the invention are fulfilled by providing a record member feed mechanism associated with a dot matrix printer station of a data terminal device and into which a record member such as a sales slip or other type of commercial document is inserted by way of a vertical guide chute to a position engaging a drive roller and a driven roller, which in turn move the record member to a printing position adjacent the print head of a printer mechanism when actuated. A control solenoid is energized to rotate the driven roller away from the record member while simultaneously rotating a platen member to a position moving the record member into engagement with the guide chute adjacent the printer mechanism. The platen is spring-urged causing the platen to deflect by an amount equal to the thickness of the record member while applying a force to the record member enabling the printer to operate at a high rate of speed. At the end of the printing operation, the solenoid is deenergized allowing the drive and driven rollers to move the record member to the next printing position. During the time the solenoid is deenergized, the record member is held in a vertical position by clip members located adjacent the guide chute.

BRIEF DESCRIPTION OF THE DRAWINGS

The foregoing and other objects, advantages and features of the invention will be described below in greater detail, taken in connection with the drawings wherein.

DESCRIPTION OF THE PREFERRED EMBODIMENT

Figure 1:
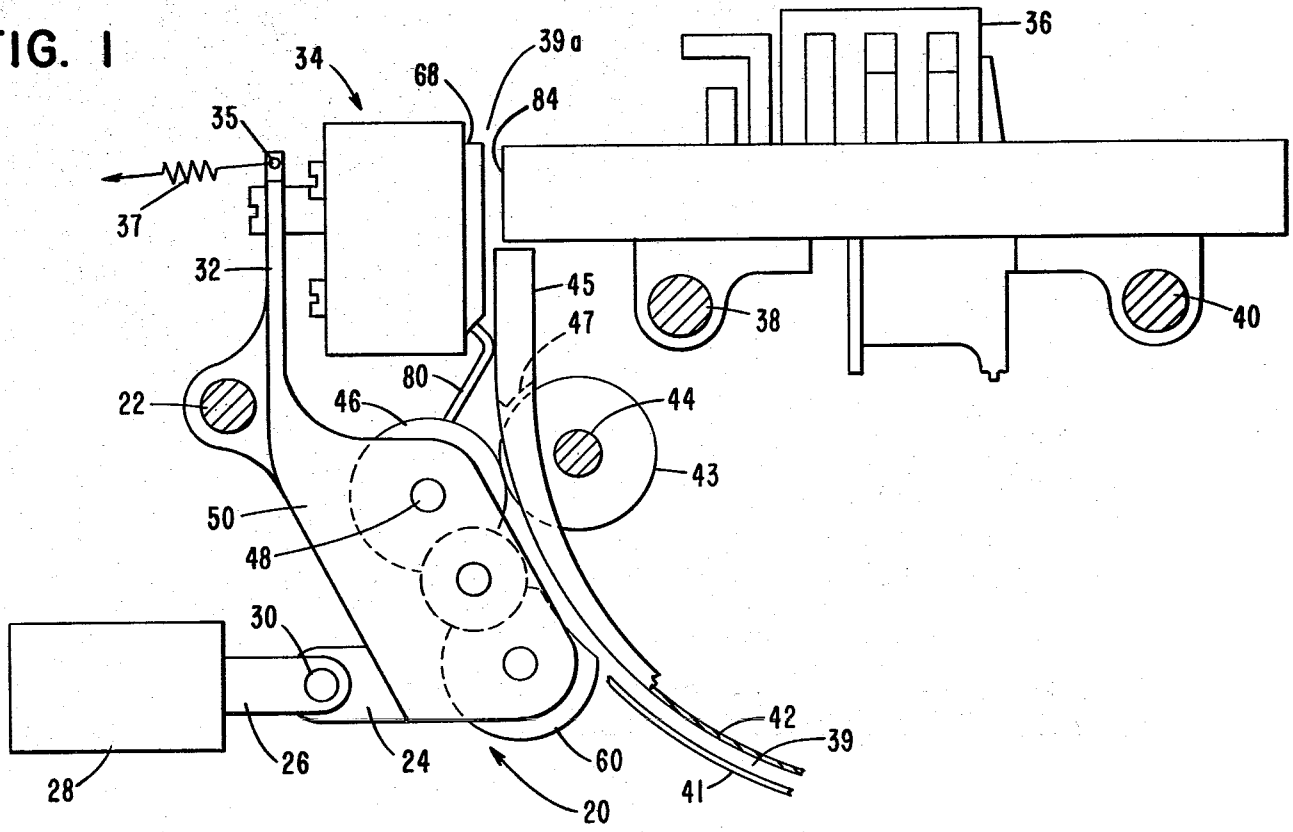
FIG. 1 is a fragmentary side elevational view of the record member feed mechanism of the present invention showing the control solenoid in a deenergized position.

Referring now to FIG. 1, there is shown a fragmentary side view of the record member feed mechanism of the present invention, which includes a rockable frame member indicated generally by the numeral 20 rotatably mounted on a shaft 22 located intermediate the ends of the frame member and extending in a horizontal direction within the data terminal device associated with the printer mechanism. The frame member 20 has located at its lower end a rearwardly extending arm extension 24 which is secured to one end of an armature member 26 of a solenoid 28 by means of a pin 30 or the like. The other end of the frame member 20 comprises a vertically extending arm extension 32 to which is mounted a platen assembly indicated generally by the numeral 34. The extension 32 of the frame member 20 includes an end portion 35 to which is secured one end of a spring member 37 whose other end is secured to a frame member (not shown) of the printer mechanism associated with the present feed mechanism for normally rotating the frame member in a counter-clockwise direction about the shaft 22. Associated with the platen assembly 34 is a dot matrix printer mechanism 36 slidably mounted on a pair of horizontally extending shaft members 38 and 40 for lateral movement along such shafts adjacent the receipt, slip and journal print stations of the terminal device in a manner that is well-known in the art.

Figure 2:
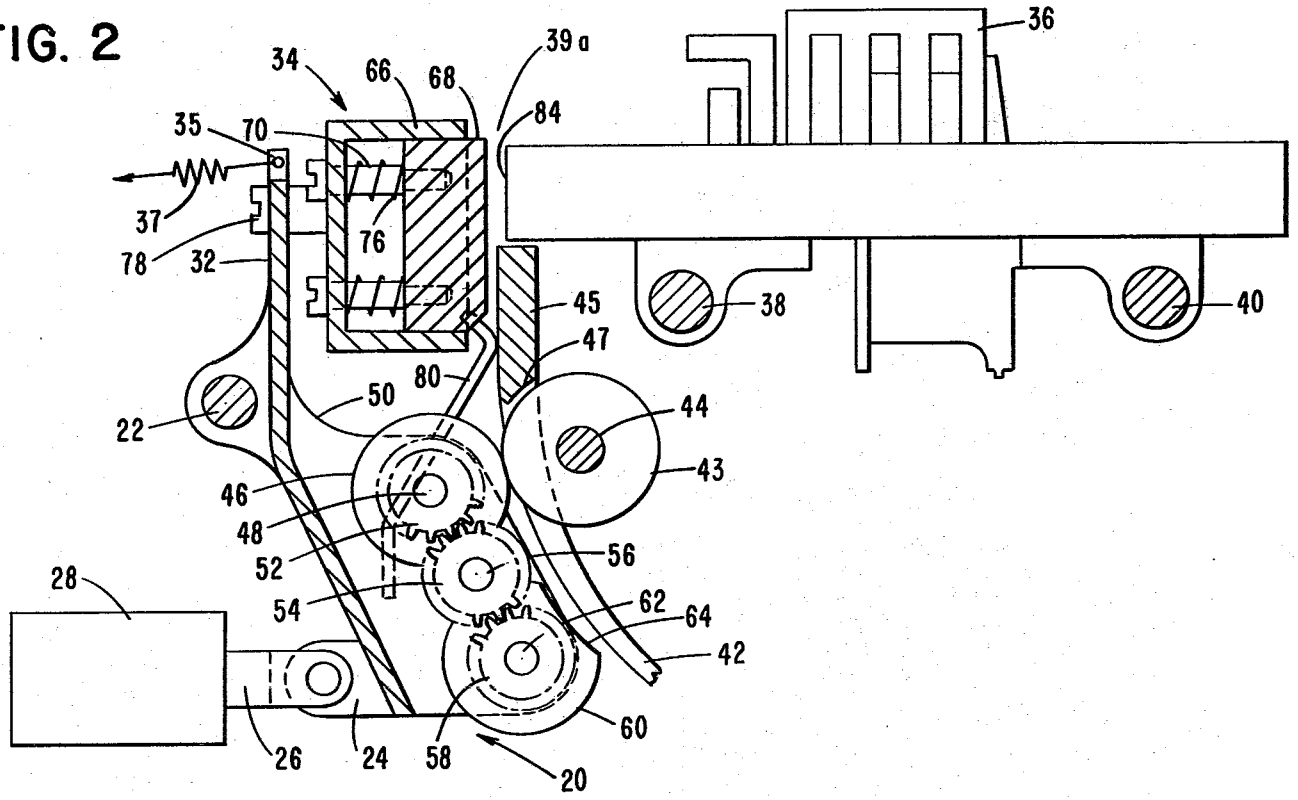
FIG. 2 is a view similar to FIG. 1 with a portion of the rockable frame member and the platen member cut away showing the details of the roller gear drive and the spring-urged platen member.

Located adjacent the frame member 20 is a guide chute 39 formed by guide plate members 41 and 42 within which a document such as a sales slip 82 (FIG. 3) is manually inserted by the operator. As illustrated, the chute plate member 41 may be of various configuration and size whereas the chute plate member 42 includes an upper portion 45 which extends in a vertical direction. Located adjacent the upper portion 45 of the member 42 and extending through an opening 47 (FIGS. 1 and 2)

of such portion 45 and into the path of movement of an inserted document is a selectively operated indexing drive roller 43. The roller 43 is preferably of rubber or similar material and is secured to an indexing drive shaft 44 which extends in a horizontal direction adjacent the printing stations associated with the sales slip, receipt and journal record members. As best shown in FIG. 2, the roller 43 normally engages a metal idler roller 46 rotatably mounted on a stud 48 secured between a pair of side frame members 50. Secured to the roller 46 is a pinion gear member 52 which engages a second pinion gear member 54 rotatably mounted on a shaft 56 also secured between the side frame members 50. The pinion gear 54 is positioned to further engage a third pinion gear 58 secured to a drive roller 60 which in turn is rotatably mounted on a shaft 62 likewise mounted between the side frame members 50. As best seen in FIG. 2, the roller 60 has a relieved or cut-out portion 64 on its peripheral drive surface, the purpose of which will be described more fully hereinafter.

The platen assembly 34 includes a housing support member 66 (FIG. 2) within which is located a metal platen member 68 secured to a pair of dowel screw members 70 slidably mounted within the support member 66. Positioned on the screw members 70 are compression spring members 76 for normally urging the platen member 68 in an outward direction towards the dot matrix printer mechanism 36. As shown in FIG. 2, the upper portion 45 of the guide plate member 42 extends to a position adjacent the lower portion of the platen member 68. The housing support member 66 is secured to the frame arm extension 32 by means of a screw member 78. Associated with the upper portion 45 of the guide plate member 42 are a pair of laterally spaced clip members 80 (one only of which is shown) which may be comprised of spring steel for engaging and holding a document positioned within the guide chute 39 against the chute upper portion 45.

Figures 3, 4:
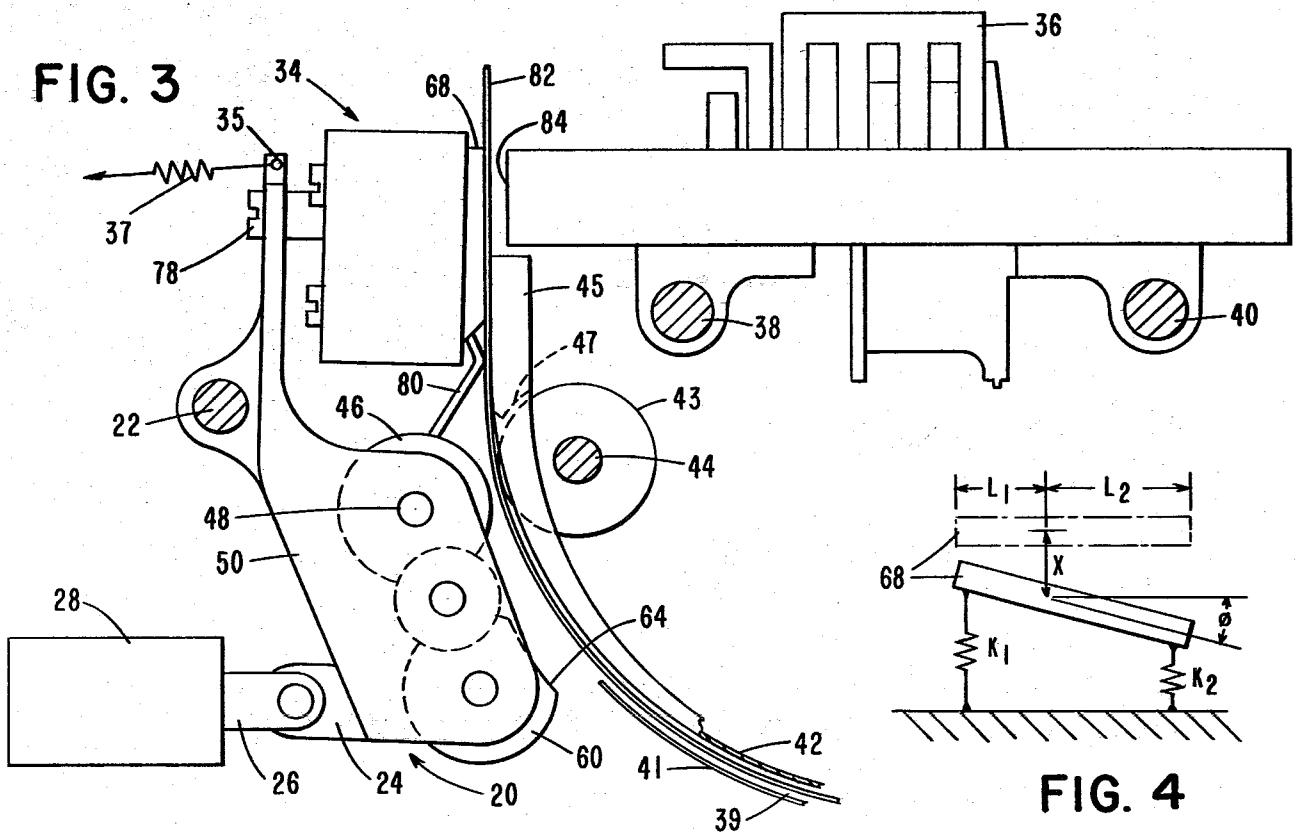
FIG. 3 is a view similar to FIG. 1 showing the feed solenoid in an energized position.
FIG. 4 is a diagrammatic illustration of the spring forces acting on the platen during movement of the platen to a printing position.

It will be seen from the above construction that the amount of pressure exerted by the platen member 68 on the sales slip or other record member 82 is controlled by the stiffness of the platen spring members 76. This value of the stiffness of the springs 76 becomes critical when the platen is involved with a dot matrix printer in which a number of print head wires are sequentially enabled to print a character on the document and which action sets up a resonant printing frequency. If the stiffness of the springs 76 selected would result in the platen member 68 deflecting in response to the striking of the print wires on the document 82 at a frequency equal to or close to the printing frequency, large movements of the platen member 68 would result tending to distort the characters printed and affecting the printing rate. In order to avoid this condition, the spring stiffness which would result in a natural deflecting frequency equal to the highest printing frequency of the printer mechanism 36 is calculated to ensure that the springs 76 selected for the design will not cause the platen to resonate at the printing frequency of the printer mechanism 36. In such calculation, the platen member 68 is treated as a two degrees of freedom spring mass system, as illustrated in FIG. 4. After determining the critical spring stiffness which would resonate at the actual print frequency of the printer mechanism 36, a value for the spring 36 stiffness is then selected which would avoid this critical spring stiffness. The stiffness of the spring member 76 which produces a resonant frequency equal to the highest print frequency is precisely calculated by the following equations, which are disclosed on page 44 of the reference "Theory and Problems of Mechanical Vibrations" by William W. Seto, published by the Schaum Publishing Company, New York, N.Y.

$$mx+(K_1+K_2)x-(K_1L_1-K_2L_2)\theta=0 \quad (1a)$$

$$J\theta+(K_1L_1^2+K_2L_2^2)\theta-(K_1L_1-K_2L_2)x=0 \quad (1b)$$

where $L_1$, $L_2$ (FIG. 4) are the distances at which the coordinates x and $\theta$ of the mass of the platen members 68 are acting, x and $\theta$ are the translational and rotational distances of the mass of the platen member 68 m is equal to the mass of the platen member 68

J is equal to the moment of inertia of the platen member 68

$K_1$, $K_2$ (FIG. 4) are equal to the stiffness of the springs 76.

If $K_1=K_2=K$ and $L_1=3L_2$

Then equations (1a) and (1b) become $$mx+Kx-2KL_2\theta=0 \quad (2a)$$

$$J\theta+10KL_2^2\theta-2KL_2x=0 \quad (2b)$$

let $$x=A\sin(wt+u)$$

$$\theta=B\sin(wt+u)$$

then $$x=-w^2xA\sin(wt+1)$$

$$\theta=-w^2B\sin(wt+1)$$

then equations (2a) and (2b) become $$(2K-w^2m)A-2KL_2B=0 \quad (3a)$$

$$(10KL_2^2-Jw^2)B-2KL_2A=0 \quad (3b)$$

The equation for determining the print frequency of the printer mechanism 36 obtained by equating to 0 the determinant of coefficient A and B, is:

$$mJw^4-(2Jw^2+10w^21L_2^21m)K+16L_2^2K^2=0 \quad (4)$$

If m=0.00098 slug w=5711.4 RAD/SEC.

J=0.001699 in·−lb·$f$−sec$^2$ $L_2$=1.125

Then equation (4) gives a value of K=21200 lb/in. and 3950 lb/in. representing the stiffness of the springs 76 which would produce a resonant frequency close to the printing frequency of the selected printer mechanism 36. To avoid this condition, the stiffness of the springs 76 are selected which would not correspond to the values of K found above.

In the operation of the record feed mechanism, the control solenoid 28 will be in a deenergized condition during the manual insertion of a document 82 within the guide chute 39 (FIGS. 1 and 3) by the operator. The document 82 will move along the guide chute 39 until it is positioned against the rollers 43 and 46. At this time the frame member 20 has been moved in a counter-clockwise direction (FIG. 1) by the action of the spring member 37 to position the idler roller 46 against the drive roller 43 in a record member blocking relationship. Upon initiation of a printing cycle, the indexing drive shaft 44 is rotated in a clockwise direction, thereby causing the drive roller 43 to rotate the rollers 46 and 60 in a counter-clockwise direction and thus drive the document 82 upwardly and through the clip members 80 to a position adjacent the print head portion 84 of the dot matrix printer mechanism 36. In this movement of the document 82, the relieved portion 64 of the roller 60, while initially enabling unobstructed movement of the record member toward and against the rollers 43 and 46, will cause its leading edge to pinch the document against the upper portion 45 of the guide plate member 42 and thereby provide an upward thrust on the document so as to help such document to be driven into engagement with the rollers 43 and 46 which then moves the document to a printing position. Although not illustrated, secured to the indexing drive shaft 44 are additional rollers similar to rollers 43 but located in the receipt and journal printing stations for driving documents in said printing stations distances similar to that of the document 82 when enabled.

After the document 82 has been driven to its printing position, the solenoid 28 is energized resulting in the clockwise rotation of the member 20 (FIG. 3), which movement disengages the roller 46 from the roller 43. The energizing of the control solenoid 28 also moves the platen member 68 against the inserted document 82 and the upper portion 45 of the guide plate member 42 resulting in the pinching of the document against the portion 45 by the platen member 68. The stiffness of the springs 76 selected will also allow the platen member 68 to move against the action of such springs 76 by that amount which is equal to the thickness of the document 82 (FIG. 3), thus enabling the wire print members (not shown) located in the print head 84 of the dot matrix printer mechanism 36 to travel the same distance during the printing operation regardless of the thickness of the document 82. After the printing operation has occurred, the solenoid 28 is deenergized, leaving the document 82 in its printed position due to its engagement by the clip members 80. The deenergizing of the solenoid 28 restores the idler roller 46 into engagement with the indexing drive roller 43 which is again actuated to move the document 82 a predetermined distance to position the next line of the document in a printing position.

It will be apparent from the construction of the rockable frame member 20 that the engagement of the rollers 43 and 46 also provides a stop for a document 82 when inserted through the top 39*a* of the chute 39, i.e. between the platen 68 and print head 84, and through the clip members 80 during a validation print operation, as in the case of a bank check or other type of financial document. If the receipt and journal print stations have different printing requirements as to the location of the printing line on a document, it will be seen that upon the disengagement of the drive roller 46 from the idler roller 43 during the energizing of the solenoid member 28, the indexing shaft 44 is free to be rotated to position the other documents in their proper position for the next printing operation during the time a printing operation is occurring at the slip printing station. One advantage of having the upper portion 45 of the guide plate member 42 position the document 82 vertically for a printing operation occurs when, after a printing operation has been completed, the printer mechanism 36 is moved laterally along the shafts 38 and 40 to print on the receipt and journal documents, thereby uncovering the sales slip document 82 and allowing for the inspection by the terminal operator of the printed data thereon.

While the invention has been described in its preferred embodiment, it is to be understood that the words which have been used are words of description rather than limitation, and that changes in construction may be made within the purview of the appended claims without departing from the true scope and spirit of the invention in its broader aspects.

We claim:

1. A mechanism for feeding and supporting a record member with respect to a printing position for receiving printed indicia along a line thereof comprising:

a chute member for guiding a record member disposed therein along a predetermined path, said chute member having an end portion positioned adjacent the printing position;

a first driven roller and a drive roller disposed on opposite sides of said chute member;

an elongated support member rotatably mounted substantially midway between its ends and extending along said chute member, said support member rotatably supporting said first driven roller at a point on one side of the rotatable mounting of said support member;

a platen member mounted on said support member on the opposite side of said rotatable mounting from said first driven roller and positioned adjacent said end portion of the chute member;

first actuating means engaging said support member adjacent said platen for rotating said support member to a first position enabling said first driven roller to engage said drive roller to feed a record member to a printing position adjacent said platen member;

and second actuating means engaging said support member adjacent said first driven roller and operated for rotating said support member to a second position removing the first driven roller from engaging with said drive roller and moving said platen member into engagement with the record member.

2. The mechanism of claim 16 which further includes supporting means secured to said end of said support member on the opposite side of said rotatable mounting from said first driven roller for slidably supporting said platen member in a direction to move the platen member into engagement with the record member upon operation of said second actuating means.

3. The mechanism of claim 2 which further includes first resilient means secured to said supporting means and engaging said platen member for normally urging said platen member in a direction towards said chute member end portion whereby upon engagement of said platen member with the record member, said platen member will move against the normal urgency of said first resilient means a distance equal to the thickness of the record member engaged thereby.

4. The mechanism of claim 3 which further includes a second driven roller rotatably mounted on said support member and positioned adjacent said chute member, dirve means interconnecting said first and second driven rollers enabling said drive roller to rotate said second driven roller, said second driven roller includes a relieved portion on its peripheral edge which engages and drives the record member into engagement with said drive roller and said first driven roller upon rotation of said first driven roller, whereby said drive roller and said first driven roller will move the record member to the printing position.

5. The mechanism of claim 3 in which the end portion of said chute member is positioned opposite a portion of the platen member whereby upon movement of the platen member against the record member, the record member is held in a printing position by the platen member and the end portion of said chute member.

6. The mechanism of claim 3 in which said first resilient means comprises a spring member in compression.

7. A printing mechanism for printing indicia along a line on a record member comprising:

a chute member having an end portion extending in a vertical direction for guiding a record member disposed therein to a printing position;

a printer member positioned adjacent the end portion for printing indicia on the record member located in the printing position;

an intermittently operated drive roller located adjacent said chute member for engaging a record member positioned in said chute member;

an elongated support member having first and second end portions, said support member being rotatably mounted substantially midway between said end portions and extending along said chute member in a parallel direction opposite said drive roller, said support member having said first end portion located adjacent the end portion of the chute member and said printing member;

a first driven roller rotatably mounted on the second end portion of said support member opposite said drive roller;

first actuating means engaging the first end portion of said support member for rotating said support member in a first direction whereby said driven roller is moved into engagement with said drive roller thereby enabling said drive roller to move a record member positioned therebetween to the printing position when operated;

a support means secured to said first end portion of said elongated support member adjacent the end portion of the chute and the printer member;

a platen member slidably carried by said support means;

second actuating means engaging said platen member for urging said support means and said platen member in a direction towards said printer member;

and third actuating means engaging the second end portion of said support member for rotating said support member in a second direction disengaging said driven roller from the record member and moving said platen member into engagement with the record member and the end portion of the chute member whereby said platen member deflects against said record member a distance equal to the thickness of said record member.

8. The printing mechanism of claim 7 in which said support means comprises a housing member, said platen member is slidably mounted on said housing member, and said second actuating means comprises spring members carried by said housing member and engaging said platen member for normally urging said platen member in a direction towards said printing member.

9. The printing mechanism of claim 8 which further includes a second driven roller rotatably mounted on said support member and positioned adjacent said chute member, drive means interconnecting said first and second driven rollers enabling said first driven roller to rotate said second driven roller and said second driven roller includes a cut-out portion on its peripheral edge which engages and drives the record member into engagement with said drive and first driven roller upon rotation of said first driven roller whereby said drive and first driven rollers will move the record member to the printing position.

10. A mechanism for feeding and supporting a record member with respect to a printing position for receiving printed indicia along a line thereof comprising:

a chute member having an end portion extending in a vertical direction for guiding a record member disposed therein along a predetermined path to a printing position;

a dot matrix printer member positioned adjacent the end portion of said chute member for printing indicia along a line on said record member located in the printing position, said printing member operating at a selected printing frequency;

an intermittently operated drive roller located adjacent one side of said chute member for engaging a record member positioned on said chute member;

an elongated support member rotatably mounted substantially midway between its ends and located adjacent the other side of said chute member opposite said drive roller, said support member having a first supporting end located adjacent said chute member and a second supporting end located adjacent the end portion of said chute member and said printer member;

a first driven roller rotatably mounted on said first supporting end opposite said drive roller;

leaf spring members normally engaging the end portion of said chute adjacent said printer member;

first spring means engaging said second supporting end for normally rotating said support member in a first direction moving said driven roller into engagement with said drive roller thereby enabling said drive roller to move a record member positioned therebetween to a position engaging said leaf spring member allowing said leaf spring member to hold said second member against the end portion of said chute member and adjacent said printer members;

a housing member secured to said second supporting end of said toggle member;

a platen member slidably mounted within said housing member;

second spring means mounted between said housing member and said platen member for normally urging said platen member in a direction towards said printer member and the end portion of said chute member;

said second spring means having a stiffness value which dampens the movement of the platen member in response to the operation of the printer member;

and electromagnetic actuating means engaging the second supporting end of said support member for rotating said support member in a second direction disengaging said driven roller from the record member and moving the housing member and the platen member in a direction in which the platen member is moved into engagement with the record member and the end portion of the chute member against the action of the second spring means whereby said platen member deflects against said second spring member a distance equal to the thickness of said record member.

* * * * *